US005301816A

United States Patent [19]

Weber et al.

[11] Patent Number: 5,301,816

[45] Date of Patent: Apr. 12, 1994

[54] METHOD AND APPARATUS FOR THE SEPARATION OF A MATERIAL MIXTURE AND USE OF THE APPARATUS

[75] Inventors: Heinrich Weber; Falko Lehrmann; Clemens Weibel, all of Oberuzwil, Switzerland

[73] Assignee: Buehler AG, Uzwil, Switzerland

[21] Appl. No.: 931,115

[22] Filed: Aug. 17, 1992

Related U.S. Application Data

[63] Continuation of Ser. No. 596,864, Oct. 12, 1990, abandoned, which is a continuation of Ser. No. 426,974, Oct. 25, 1989, abandoned, and a continuation-in-part of Ser. No. 582,969, Oct. 11, 1990, abandoned.

[30] Foreign Application Priority Data

Jul. 28, 1989 [CH] Switzerland ..... 02823/89

[51] Int. Cl.[5] ..... B07C 5/36

[52] U.S. Cl. ..... 209/616; 209/631; 209/640; 209/665; 209/689; 209/930

[58] Field of Search ..... 209/629, 615, 616, 645, 209/646, 938, 689, 44.2, 642, 640, 686, 631, 665, 707, 700

[56] References Cited

U.S. PATENT DOCUMENTS

| | | | |
|---|---|---|---|
| 1,182,144 | 5/1916 | Corbin | 209/616 |
| 1,837,299 | 12/1931 | Taggart | 209/44.2 X |
| 2,114,263 | 4/1938 | Heaslet | 209/616 |
| 2,769,539 | 11/1956 | Packman | 209/616 X |
| 4,744,470 | 5/1988 | Feller et al. | 209/640 |
| 4,760,925 | 8/1988 | Stehle et al. | 209/930 X |
| 4,778,061 | 10/1988 | Williams | 209/930 X |
| 5,024,335 | 6/1991 | Lundell | 209/930 X |

FOREIGN PATENT DOCUMENTS

| | | | |
|---|---|---|---|
| 1086936 | 8/1960 | Fed. Rep. of Germany | 209/615 |
| 2481617 | 11/1981 | France | 209/631 |
| 581610 | 10/1946 | United Kingdom | 209/700 |
| 2010128 | 6/1979 | United Kingdom | 209/616 |
| 2198661 | 6/1988 | United Kingdom | 209/616 |

*Primary Examiner*—D. Glenn Dayoan
*Attorney, Agent, or Firm*—McAulay Fisher Nissen Goldberg & Kiel

[57] ABSTRACT

A new separating method and a corresponding apparatus and the use of the apparatus for the environmentally sound separation of different material mixtures, are disclosed wherein, in addition to dynamic forces, the area pressure between the bodies to be sorted and an inwardly elastic sorting drum are made of use. Bodies which are heavy with respect to specific area pressure sink into the interior of the drum and are thrown out at a lower location. Parts which are light with respect to specific area pressure, on the other hand, are rejected from the surface of the drum and guided away separately. In so doing, the device achieves very efficient separation. The invention is particularly effective for the separation of reclaimable material mixtures, so-called "recyclables", particularly with respect to fractions such as liftings which are otherwise difficult to separate.

33 Claims, 3 Drawing Sheets

METHOD AND APPARATUS FOR THE SEPARATION OF A MATERIAL MIXTURE AND USE OF THE APPARATUS

This application is a continuation of application Ser. No. 07/596,864 filed Oct. 12, 1990 which is a continuation of Ser. No. 426,974 filed Oct. 25, 1989, both abandoned and Ser. No. 582,969 filed Oct. 11, 1990, now abandoned.

TECHNICAL FIELD

The invention is directed to a method, an apparatus and the use of the apparatus for the environmentally sound separation of a material mixture, e.g. a mixture of reclaimable material (recyclables), into individual material components of different character, wherein the material mixture is continuously fed to a rotating, inwardly elastic sorting drum.

BACKGROUND ART

In the environmentally sound processing e.g. of recyclable material mixtures, container waste, and components similar to household waste, the problem arises of separating specific categories of recyclables materials as completely as possible. Both the sieving technique and the air separation technique are limited. Since organic, highly adhesive components or fine dust components also often occur in the aforementioned recyclables, separation by air or sieves involves corresponding disadvantages.

In individual cases it is unavoidable that vastly different collected material, e.g. liftings, are to be sorted into easily reclaimable organic components and heavy fractions intended for recyclables or dumps.

In recent times, repeated efforts have been made for a recycling which is as complete as possible, at least with glass receptacles, cans, aluminum cans, plastic bottles, etc. The newly developing flow of material must be separated in an efficient manner, so that the individual base materials such as glass and aluminum can be returned to other respective processing centers at a minimum of expense. In the case of glass, it is required that there be as little glass breakage as possible. This rules out an excessively large massing. The consequence of this would be many small plants, if possible in the vicinity of the consumers.

The current practice is sorting into different categories of material by hand. A typical characteristic of all highly industrialized societies is the high cost for all manual labor. The required high expenditure on manual labor often stands in the way of the complete success of a genuine recycling.

A solution is known in U.S. Pat. No. 4,760,925 in which the mixture is separated into a heavy fraction and a light fraction by means of a brush shaft following a pre-separation by means of a slope conveyor belt. In this patent, heavy parts fall down directly without being influenced by the brush movement. Tests conducted by the present Applicant showed only an insufficient or fluctuating separation quality when the product was conveyed, as it were, frontally to the sorting drum, and the heavy fraction is sorted out opposite the movement direction of the sorting drum and the lighter fraction is lifted over around the drum radius and thrown to the other side of the drum.

DISCLOSURE OF INVENTION

The object of the invention is to achieve a powerful separating effect for different kinds of material mixtures with the use of simple, inexpensive operating means and the corresponding methodology, respectively. Moreover, as little energy as possible is to be used for operation, and it should be possible for a small number of trained personnel to operate.

The solution, according to the invention, is characterized in that the raw material is continuously fed to an inwardly elastic drum which is set in rotation, wherein, as a function of the area pressure, a fraction sinks into the drum and a second fraction remains on the surface and is rejection from the drum.

The method, according to the invention, is characterized in that the material mixture is guided to the sorting drum in the same direction as the surface movement and divided into fractions in the movement direction of the sorting drum.

To the surprise of all participants knowledgeable in the field, it was possible to achieve an unexpectedly excellent sorting quality already with a first, very simply conceived test device. For example, it was possible after a few test runs to divide a mixture of glass bottles and plastic and aluminum cans, as occur in corresponding U.S. collection locations, into glass and remaining components with an accuracy of almost 100%. A centrifugal drum brush, as is known in car washing installations, was used for the test. The energy requirement for the sorting amounts to only a low percentage of that of systems utilizing the air sorting solution. When observing the test for the first time, the observer did not even immediately grasp why, without an immediately visibly detectable cause, the glass bottle sank in the rotating direction of the sorting drum and was discharged at the bottom, but the plastic bottles were rejected with complete accuracy and thrown into an adjoining collecting container or onto a corresponding discharging element, respectively. The present invention showed for the first time that the parameter of area pressure allows a new excellent sorting technique for many sorting problems, particularly with bodies which do not have a determined shape from the beginning, when the heavy bodies sink substantially radially and not tangentially. The weight, per se, and the size still only play a secondary role for the genuine area pressing sorting technique. The success of the sorting is due chiefly to the area pressure and the corresponding centrifugal penetration-inhibiting force dynamic produced by the rotation of the sorting drum, respectively, on the one hand, and the dynamic interplay between the bristles and the bodies to be sorted on the other hand. The separation of the mixture components is to occur on the throw-off side in the ejecting direction of the bristles of the centrifugal drum, since it is only in this manner that the plurality of bristles are compelled to interact with each particle of the mixture in a genuinely selective manner so as to exert separating force. The actual separation is effected between light and heavy bodies with respect to specific area pressure.

In another test, a material mixture which was presorted through a sieve as liftings had to be divided into a mechanical fraction and an organic fraction. A surprisingly good separating quality was also achieved in this case, particularly when the material mixture previously only contained portions which were e.g. smaller than a foot, e.g. smaller than 250 to 300 mm.

The invention allows different particularly preferred embodiment ideas.

In an especially preferred manner, the sorting drum is constructed as a centrifugal drum brush and the elasticity or impressibility of the sorting drum and the area pressure resulting from this, respectively, is determined by corresponding selection of the speed and/or the outfitting of the sorting drum (with bristles). The largest possible body which can be separated out is determined by the length of the bristles.

In addition, the raw material is preferably fed continuously to the cylindrical outer surface area of a sorting drum by a feed unit. It is suggested that the raw material be fed in the area on the sorting drum located at the top, especially preferably in the highest area.

Depending on the material mixture, the sorting quality is increased in that the material to be separated is delivered with more tangential components with respect to the sorting drum or with more radial components. The previous tests have shown that the raw material on the feed unit is to be pre-accelerated to approximately 10 to 30%, preferably 10 to 25%, of the circumferential speed of the sorting drum.

In addition, it is known that the sorting drum produces a strong air current which can be directed. This can be utilized for the separation of an additional light fraction such as paper pieces, threads, strings, etc. At the same time, the air current prevents strings and the like from winding around the sorting drum in a highly reliable manner, so that a very high operating reliability can be achieved.

The invention further concerns an apparatus for the separation of a material mixture into individual material components as previously described. The apparatus, according to the invention, is characterized in that it comprises a feed device for the continuous delivery of the material mixture into an upper sector, preferably corresponding to 11 o'clock to 2 o'clock, but particularly preferably 12 and 1 o'clock, (as seen in cross section) in the direction of the surface movement of the sorting drum. A light portion discharge is preferably arranged on the throw-off side approximately at the height of the rotational axis of the drum and a heavy portion discharge is preferably arranged in the lower adjacent quadrant. The sorting drum is preferably constructed as a centrifugal drum brush; e.g. in the event that a washing brush for car washing systems is used the drum effect first develops in the operating state. When stopped, the bristles hang down. The resistance behavior for the penetration of bodies into the interior of the sorting drum is determined by means of the centrifugal force occurring during rotation and by means of the selection of the quantity and the quality of the bristles. The rejecting force of every rotating brush and the air current which is adjusted produce the impulse for the rejection of the parts which are lighter with respect to specific area pressure.

It is particularly preferred that the material mixture feed means be constructed as a belt or acceleration belt, especially preferably with a sieve connected prior to it or as a rod chain grate conveyor or as a stationary sieve, particularly as a bar sieve.

It is further suggested that the conveying speed of the feed device be 0.5 to 2 m/sec, preferably 1.2 to 1.5 m/sec, and that the circumferential speed of the drum be 5 to 15 m/sec, preferably 7 to 10 m/sec, at a diameter of 1 to 1.5 m.

The invention is further directed to the use of a centrifugal drum brush for the sorting material mixtures such as container waste, e.g. mixed construction site refuse, road excavation refuse, construction material remains and collection material similar to household waste, which are preferably pre-sorted via sieves, wherein the heavy fraction substantially contains mineral components and the light fraction substantially contains the organic materials.

For a better understanding of the present invention, reference is made to the following description and accompanying drawings while the scope of the invention will be pointed out in the appended claims.

BRIEF DESCRIPTION OF THE INVENTION

BEST MODE FOR CARRYING OUT THE INVENTION (PREFERRED EMBODIMENTS)

Figure 1:
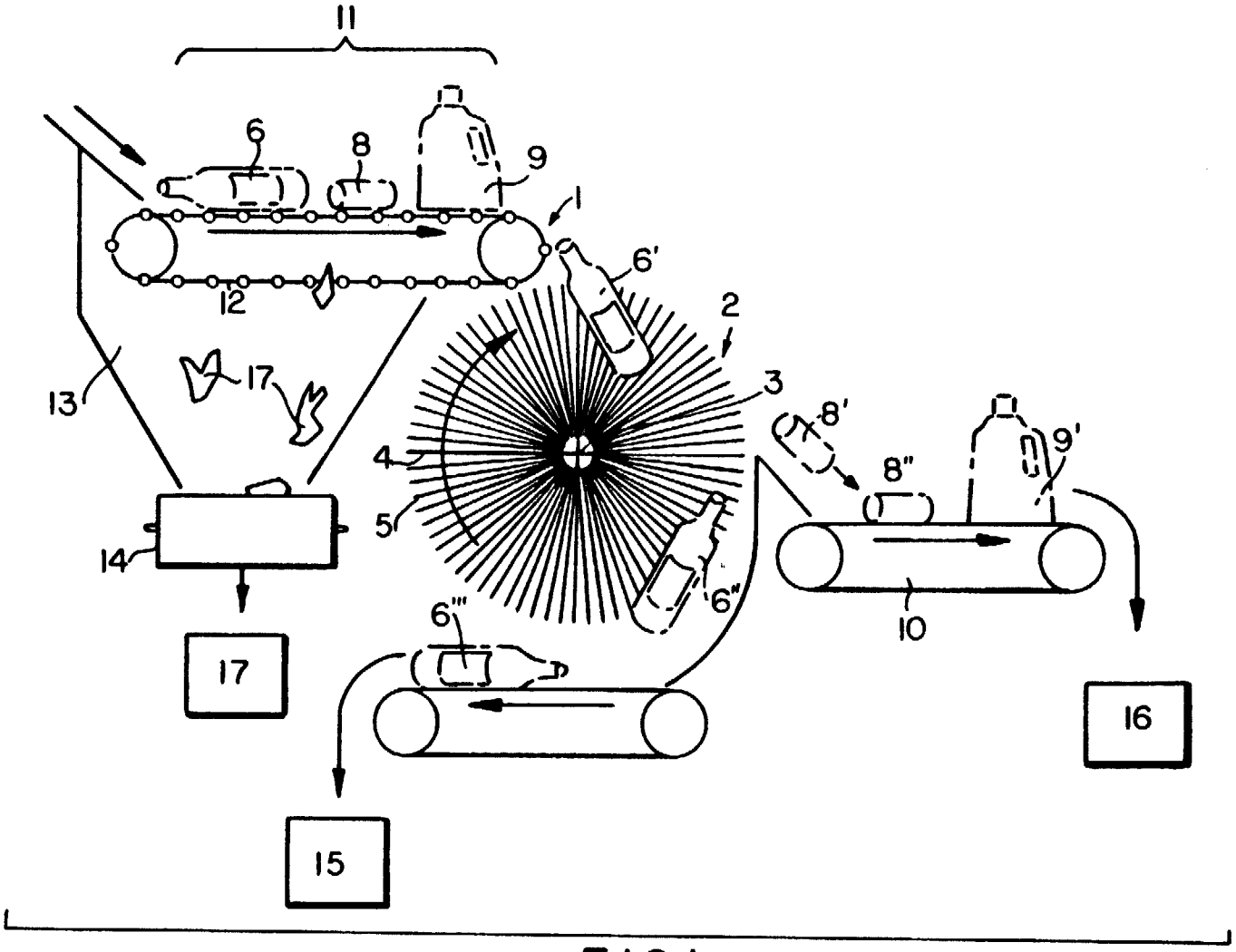
FIG. 1 shows a first embodiment example in a schematic manner.

Reference is now made to FIG. 1. The material mixture 11 is transferred directly to a sorting drum 2 via a feed device 1. The sorting drum 2 is driven via a shaft 3. Bristles 4 which are put into a cylindrical shape 5 by means of the rotation of the shaft 3 and the acting centrifugal force, respectively, are fastened at the shaft 3. Due to a much higher area pressure, glass bottles 6 sink into the interior of the drum as shown with bottles 6' and 6''. The bottle 6'' is transferred to a discharge belt 7 for heavy material 15 below the sorting drum 1 and fed to a corresponding collector. Bodies, such as aluminum cans and plastic bottles, which exert only a slight area pressure when impacting on the sorting drum 2, are thrown off tangentially from the drum surface by the bristles 4 when impacting on the latter (see aluminum can 8, 8' and 8'', respectively, and plastic bottle 9, 9'). The latter are transferred to a collector for medium material 16 via a second discharge belt 10.

The material mixture 11 is divided into three fractions according to FIG. 1. The heavy material 15 contains all bodies exerting a large area pressure on the sorting drum 2, such as glass bottles, solid metal bodies or e.g. heavy stones in the material mixture would also be sorted out with the heavy fraction 15. The medium material 16 contains all light hollow bodies such as aluminum cans and plastic bottles. Iron cans can be sorted out by means of magnet separators, either before or after the sorting drum.

Any fine component in the material mixture, particularly also broken glass, is sieved out prior to the sorting drum 2 by means of a feed device 1 constructed as a rod chain grate conveyor 12 and fed to a collector for fine material 17 via a funnel 3 and a belt conveyor 14.

Figure 2:
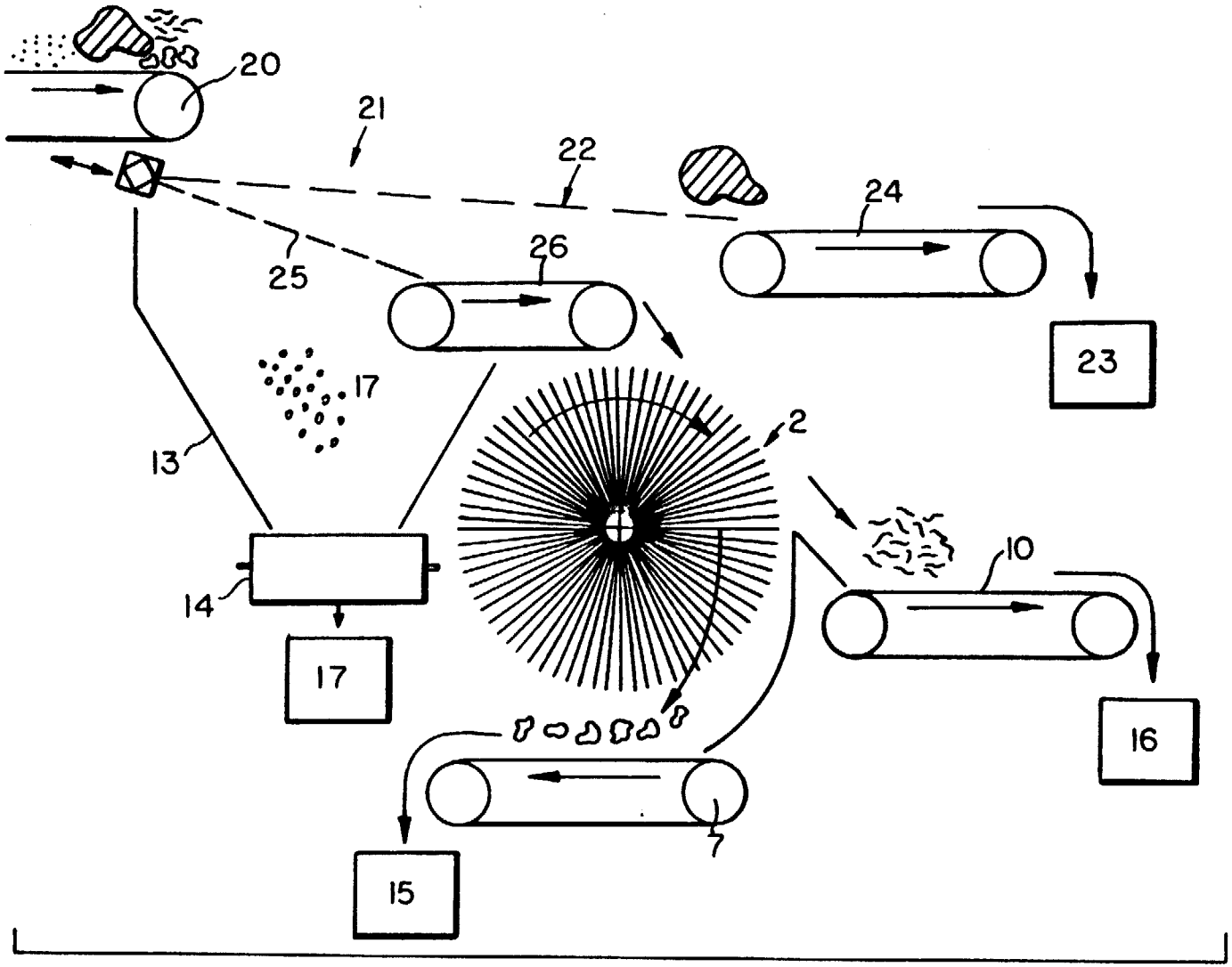
FIG. 2 shows an embodiment form for container waste in a schematic manner.

FIG. 2 shows, in a schematic manner, a sorting device for container waste with components similar to household waste. A pre-grading of the raw material mixture is important in container waste. The raw material mixture is transferred continuously via a feed belt 20 to a sieving system or a sieving stage 21. An upper or preliminary coarse sieve 22 removes all parts e.g. larger than the size of a foot, e.g. larger than 250 to 250 mm, e.g. large pieces of stone, larger pieces of wood, etc. The tailings of the coarse sieve 22 are separated out as coarse material 23 directly via a belt 24. Fine material 17 falls through the coarse sieve 22 as well as through a fine sieve 25 arranged under the latter and is discharged via a funnel 13 and a belt conveyor 14.

The medium fraction of the raw material mixture is transferred to an acceleration belt 26 as tailings of the sieving stage 21. Depending on the case of application, the acceleration belt 26 is provided with an adjustable drive motor, not shown, so that the conveying speed of the material mixture can be specifically selected in the area where it impacts on the sorting drum 2. The acceleration belt 26, which can be operated regardless of the prior processing, offers in every event the possibility of a defined feeding of the material mixture to the sorting drum 2. It is also possible to arrange additional aligning means in the acceleration belt 26, so that at least the parts which are difficult to sort impact on the sorting drum 2 in the optimal direction and position. Stones and the like, as heavy material 15 with a large area pressure, sink into the sorting drum 2 and are carried off in a downward direction via the discharge belt 7. Medium material 16, which contains predominantly organic components, is discharged via the discharge belt 10.

Figure 3:
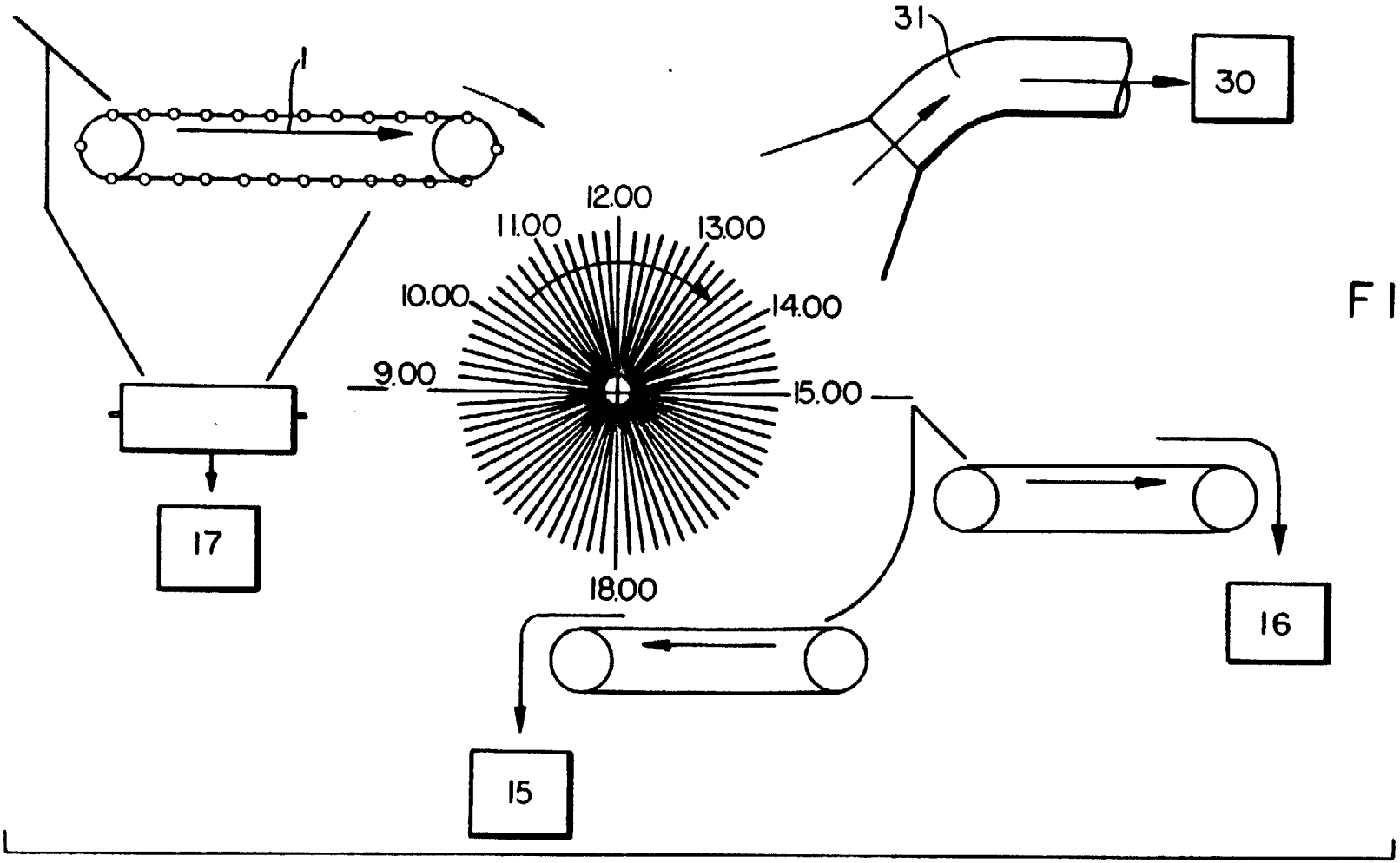
FIG. 3 shows an embodiment example for the additional suction of a light fraction such as foils, paper, etc.

FIG. 3 shows another embodiment idea. In contrast to FIGS. 1 and 2, material 30, e.g paper pieces, very small pieces of plastic and the like, are additionally sucked away via an aspirator 31 according to FIG. 3.

It has been shown that the new sorting idea can be put to use in a number of different areas of application. Thus, it is possible to separate many agricultural products into individual components, e.g. freshly harvested potatoes. The latter can be separated from dirt and large stones with a very high accuracy of separation.

While the foregoing description and drawings represent the preferred embodiments of the present invention, it will be obvious to those skilled in the art that various changes and modifications may be made therein without departing from the true spirit and scope of the present invention.

What is claimed is:

1. In a method for environmentally sound separation of a material mixture into individual material components of different character, wherein the material mixture is continuously fed to a rotating inwardly elastic sorting drum from a depositing area, the drum having a direction of rotation and an axis of rotation, the improved method comprising the steps of:

guiding the material mixture above the sorting drum and dropping the mixture into contact with the sorting drum, causing the material mixture to travel with the drum, in the direction of drum rotation; and, dividing the material mixture into fractions of material components according to a common characteristic as the mixture travels with the drum, in the direction of drum rotation.

2. The method according to claim 1, wherein the contact between the individual material components of the material mixture and the sorting drum creates an area pressure, the method including the steps of:

absorbing a fraction of the material mixture which creates a greater area pressure within the sorting drum and delivering the fraction below the sorting drum; and, suspending a second fraction of the material mixture which creates a smaller area pressure and delivering the second fraction tangentially from the sorting drum.

3. The method according to claim 1, including delivering the material mixture to the sorting drum on a feed device with tangential components, the mixture being preaccelerated to approximately 10 to 30% of the circumferential speed of the sorting drum.

4. The method according to claim 1, including producing an air current through the sorting drum and utilizing this air current for separating out an additional light fraction.

5. The method according to claim 3, wherein the material mixture is preaccelerated to 10 to 25% of the circumferential speed of the sorting drum.

6. In a method for environmentally sound separation of a material mixture into individual material components of different character, wherein the material mixture is continuously fed to a rotating inwardly elastic sorting drum from a depositing area, the drum having a direction of rotation and an axis of rotation, the improved method comprising the steps of:

constructing the sorting drum as a centrifugal drum brush, the drum brush having bristles with rigidity, elasticity, a circumferential speed, wherein the drum brush takes on a cylindrical shape when rotated at the circumferential speed;

guiding the material mixture above the sorting drum and dropping the mixture into contact with the sorting drum, the contact creating an area pressure;

absorbing a fraction of the material components which creates a greater area pressure within the sorting drum and delivering the fraction below the sorting drum, wherein the fraction travels within the drum brush in the direction of drum rotation;

suspending a second fraction of the material components which creates a smaller area pressure and delivering the second fraction tangentially from the sorting drum, wherein the second fraction travels substantially on the drum brush in the direction of drum rotation; and, determining the elasticity of the drum and the area pressure created by the contact between the individual material components of the material mixture and the drum, by selecting the circumferential speed of the drum and the rigidity of the drum bristles.

7. The method according to claim 6, wherein the delivery area is located above the drum on a vertical line perpendicular to the axis of rotation.

8. The method according to claim 7, wherein a grading sieving system is connected prior to the sorting drum.

9. An apparatus for the separation of a material mixture into individual lighter and heavier material components, comprising:

an inwardly elastic sorting drum having an axis of rotation and a direction of rotation; and, a feed device for the continuous delivery of the material mixture from a depositing area above the sorting drum, the mixture dropping into contact with the sorting drum, causing the material mixture to separate into said lighter and heavier material components as said mixture travels with the drum, in the direction of drum rotation.

10. The apparatus according to claim 9, wherein a discharge belt for transporting the lighter material components is arranged approximately parallel to the axis of rotation of the drum and a discharge belt for transporting the heavier material components is arranged below the axis of rotation of the drum.

11. The apparatus according to claim 10, wherein the sorting drum is constructed as a centrifugal drum brush and has a cylindrical shape.

12. The apparatus according to claim 10 or 11, wherein means for grading is arranged prior to the sorting drum for separating out excessively large and small sizes.

13. The apparatus according to claim 9, wherein, the feed device is constructed as a material mixture acceleration element having means for changing the direction of the delivery of the mixture.

14. The apparatus according to claim 9, wherein the feed device is constructed as a belt conveyor.

15. The apparatus according to claim 9, wherein the sorting drum has a diameter of 1 to 1.5 meters.

16. The apparatus according to claim 9, wherein the depositing area ranges −30 degrees to +60 degrees from a vertical line drawn perpendicular to the axis of rotation, in the direction of rotation.

17. The apparatus according to claim 9, wherein the depositing area ranges −30 degrees to +60 degrees from a vertical line drawn perpendicular to the axis of rotation, in the direction of rotation.

18. The apparatus according to claim 9, wherein, the feed device is constructed as a material mixture acceleration element having means for changing the speed of the delivery of the goods.

19. The apparatus according to claim 9, wherein the feed device is constructed as a rod chain grate conveyor.

20. The apparatus according to claim 9, wherein the feed device is constructed as a stationary bar sieve.

21. The apparatus according to claim 15, wherein the feed device has a conveying speed, the conveying speed being between 0.5 and 2 meters per second.

22. The apparatus according to claim 21, wherein the conveying speed of the feed device is 1.2 to 1.5 meters per second.

23. The apparatus according to claim 15, wherein the circumferential speed of the sorting drum is 6 to 15 meters per second.

24. The apparatus according to claim 15, wherein the circumferential speed of the sorting drum is 7 to 10 meters per second.

25. A method for the separation of a material mixture into individual lighter and heavier material components, the method comprising the steps of:

continuously feeding the material mixture above the drum; and, dropping the mixture into contact with an inwardly elastic drum from a depositing area, the drum having a direction of rotation and the depositing area ranging +30 degrees from a vertical line positioned perpendicular to the axis of rotation, wherein, the heavier fraction sinks into the drum and is delivered below the drum, and the lighter fraction is suspended by the drum and is rejected tangentially from the drum.

26. The method according to claim 25, including feeding the material mixture continuously to the drum by a feed unit, wherein the brush is cylindrically constructed.

27. The method according to claim 25, wherein the depositing area ranges +30 degrees from a vertical line positioned perpendicular to the axis of rotation.

28. The method according to claim 25, comprising constructing the drum as a centrifugal-force drum brush having bristles, the bristles having rigidity, wherein the elasticity of the drum is determined by the rigidity of the bristles of the drum brush.

29. A method for the separation of a material mixture into individual lighter and heavier material components, the method comprising the steps of:

continuously feeding the material mixture above an inwardly elastic centrifugal-force drum brush, wherein elasticity of the brush is determined by the circumferential speed of the brush; and, dropping the mixture into contact with the brush from a depositing area, the brush having a direction of rotation, wherein, the heavier fraction of material components sink into the brush and is delivered below the brush, and the lighter fraction of material components is suspended by the brush and is rejected tangentially from the brush.

30. The method according to claim 29, including feeding the material mixture continuously to the brush by a feed unit, wherein the brush is cylindrically constructed.

31. The method according to claim 29, wherein the depositing area ranges +30 degrees from a vertical line positioned perpendicular to the axis of rotation.

32. In a method for environmentally sound separation of a material mixture into individual material components of different character, wherein the material mixture is continuously fed to a rotating inwardly elastic drum from a depositing area, the drum having a direction of rotation and an axis of rotation, the improved method comprising the steps of:

constructing the sorting drum as a centrifugal drum brush, the brush having bristles with rigidity, elasticity and a circumferential speed, wherein the brush is cylindrically shaped when rotated at the circumferential speed;

guiding the material mixture above the rotating brush and dropping the mixture into contact with the brush, causing the material mixture to travel with the brush, in the direction of brush rotation, wherein an area pressure is created by the contact; and, dividing the material mixture of material components according to a common characteristic into fractions as the mixture travels with the drum, in the direction of drum rotation, wherein the elasticity of the brush and the area pressure created by the contact is determined by selecting the rigidity of the bristles.

33. In a method for environmentally sound separation of a material mixture into individual material components of different character, wherein the material mixture is continuously fed to a rotating inwardly elastic drum from a depositing area, the drum having a direction of rotation and an axis of rotation, the improved method comprising the steps of:

constructing the sorting drum as a centrifugal drum brush, the brush having bristles with rigidity, elasticity and a circumferential speed, wherein the brush is cylindrically shaped when rotated at the circumferential speed;

guiding the material mixture above the rotating brush and dropping the mixture into contact with the brush, causing the material mixture to travel with the brush, in the direction of brush rotation, wherein an area pressure is created by the contact; and, dividing the material mixture into fractions of material components according to a common characteristic as the mixture travels with the drum, in the direction of drum rotation, wherein the elasticity of the brush and the area pressure created by the contact is determined by selecting the number of bristles per unit area.

* * * * *